US008194004B2

(12) United States Patent
Nishimura et al.

(10) Patent No.: US 8,194,004 B2
(45) Date of Patent: Jun. 5, 2012

(54) PLASMA DISPLAY PANEL DRIVING METHOD AND PLASMA DISPLAY DEVICE

(75) Inventors: Kenji Nishimura, Hyogo (JP); Akira Yawata, Osaka (JP); Hironari Taniguchi, Osaka (JP)

(73) Assignee: Panasonic Corporation, Osaka (JP)

( * ) Notice: Subject to any disclaimer, the term of this patent is extended or adjusted under 35 U.S.C. 154(b) by 793 days.

(21) Appl. No.: 11/909,877

(22) PCT Filed: Feb. 22, 2007

(86) PCT No.: PCT/JP2007/053293

§ 371 (c)(1),
(2), (4) Date: Sep. 27, 2007

(87) PCT Pub. No.: WO2007/105447

PCT Pub. Date: Sep. 20, 2007

(65) Prior Publication Data

US 2009/0201285 A1 Aug. 13, 2009

(30) Foreign Application Priority Data

Feb. 23, 2006 (JP) ..... 2006-046566
Feb. 23, 2006 (JP) ..... 2006-046567
Feb. 23, 2006 (JP) ..... 2006-046568

(51) Int. Cl.
*G09G 3/28* (2006.01)

(52) U.S. Cl. ..... 345/63; 345/60; 345/68; 315/169.1; 315/169.3

(58) Field of Classification Search ..... 345/60–69, 345/204, 690; 315/169.1–169.3
See application file for complete search history.

(56) References Cited

U.S. PATENT DOCUMENTS 6,326,938 B1 12/2001 Ishida et al.
6,331,843 B1 12/2001 Kasahara et al.
6,388,678 B1 5/2002 Kasahara et al.
7,023,406 B1 * 4/2006 Nunomura et al. ..... 345/63
7,576,711 B2 * 8/2009 An ..... 345/60
2001/0006377 A1 7/2001 Kasahara et al.

(Continued)

FOREIGN PATENT DOCUMENTS

JP 11-231824 A 8/1999

(Continued)

OTHER PUBLICATIONS

Japanese language International Search Report for PCT/JP2007/053293, dated May 15, 2007.

*Primary Examiner* — Quan-Zhen Wang
*Assistant Examiner* — Jennifer Nguyen
(74) *Attorney, Agent, or Firm* — RatnerPrestia

(57) ABSTRACT

A plasma display driving method capable of displaying a vigorous image having enhanced maximum luminance and contrast. For this purpose, one field is divided into a plurality of sub-fields each including a sustain period. In the sustain period, the number of sustain pulses obtained by multiplying a proportionality factor by a brightness weight set for each of the sub-fields are applied to display electrode pairs to generate sustaining discharge in discharge cells having generated addressing discharge therein. Thus, the total number of the sustain pulses in one field period can be changed. When a predetermined image meeting predetermined conditions is displayed, the total number of the sustain pulses in one field period is made larger than those in the case where the other normal images are displayed.

3 Claims, 12 Drawing Sheets

U.S. PATENT DOCUMENTS

| | | | | |
|---|---|---|---|---|
| 2001/0006378 | A1 | 7/2001 | Kasahara et al. | |
| 2001/0006379 | A1 | 7/2001 | Kasahara et al. | |
| 2001/0011976 | A1 | 8/2001 | Kasahara et al. | |
| 2001/0020938 | A1 | 9/2001 | Kasahara et al. | |
| 2002/0005857 | A1 | 1/2002 | Kasahara et al. | |
| 2002/0036650 | A1 | 3/2002 | Kasahara et al. | |
| 2005/0035928 | A1 | 2/2005 | De Greef | |
| 2005/0128167 | A1* | 6/2005 | Yoon et al. | 345/60 |
| 2006/0007250 | A1* | 1/2006 | Jung et al. | 345/690 |
| 2006/0007251 | A1* | 1/2006 | Park et al. | 345/690 |

FOREIGN PATENT DOCUMENTS

| | | | |
|---|---|---|---|
| JP | 11-231825 | A | 8/1999 |
| JP | 2000-242224 | A | 9/2000 |
| JP | 2000-330505 | A | 11/2000 |
| KR | 1999-0077738 | A | 10/1999 |
| KR | 2000-70776 | A | 11/2000 |
| KR | 10-0366034 | | 12/2002 |
| KR | 2003-0046842 | A | 6/2003 |
| KR | 10-2004-0079943 | A | 9/2004 |
| SK | 2007/053293 | | 9/2010 |

* cited by examiner

FIG. 5

| Driving mode | | Number of SFs | Luminance factor | (Upper:) Number of sustain pulses, (Lower:) Brightness weight | | | | | | | | | | Total number of sustain pulses |
|---|---|---|---|---|---|---|---|---|---|---|---|---|---|---|
| | | | | 1st SF | 2nd SF | 3rd SF | 4th SF | 5th SF | 6th SF | 7th SF | 8th SF | 9th SF | 10th SF | |
| High contrast mode | 8th | 7 | 5.500 | 11<br>2 | 22<br>4 | 44<br>8 | 88<br>16 | 177<br>32 | 355<br>64 | 713<br>128 | | | | 1410 |
| | 7th | 8 | 5.160 | 5<br>1 | 10<br>2 | 21<br>4 | 41<br>8 | 83<br>16 | 165<br>32 | 330<br>64 | 662<br>128 | | | 1317 |
| | 6th | 8 | 4.841 | 5<br>1 | 10<br>2 | 19<br>4 | 39<br>8 | 77<br>16 | 155<br>32 | 310<br>64 | 622<br>128 | | | 1237 |
| | 5th | 8 | 4.541 | 5<br>1 | 9<br>2 | 18<br>4 | 36<br>8 | 73<br>16 | 145<br>32 | 291<br>64 | 583<br>128 | | | 1160 |
| | 4th | 8 | 4.260 | 4<br>1 | 9<br>2 | 17<br>4 | 34<br>8 | 68<br>16 | 136<br>32 | 273<br>64 | 546<br>128 | | | 1087 |
| | 3rd | 9 | 3.997 | 4<br>1 | 8<br>2 | 16<br>4 | 32<br>8 | 64<br>16 | 128<br>32 | 192<br>48 | 256<br>64 | 321<br>80 | | 1021 |
| | 2nd | 9 | 3.750 | 4<br>1 | 8<br>2 | 15<br>4 | 30<br>8 | 60<br>16 | 120<br>32 | 180<br>48 | 240<br>64 | 301<br>80 | | 958 |
| | 1st | 9 | 3.518 | 4<br>1 | 7<br>2 | 14<br>4 | 28<br>8 | 56<br>16 | 113<br>32 | 169<br>48 | 225<br>64 | 282<br>80 | | 898 |
| Normal driving mode | | 10 | 3.250 | 3<br>1 | 6<br>2 | 10<br>3 | 19<br>6 | 39<br>12 | 71<br>22 | 120<br>37 | 146<br>45 | 185<br>57 | 230<br>71 | 829 |
| | | | | | | | | | | | | | | |
| | | 10 | 1.000 | 1<br>1 | 2<br>2 | 3<br>3 | 6<br>6 | 12<br>12 | 22<br>22 | 37<br>37 | 45<br>45 | 57<br>57 | 71<br>71 | 256 |

FIG. 11

| Driving mode | Number of SFs | Luminance factor | (Upper:)Number of sustain pulses<br>(Lower:) Brightness weight | | | | | | | | | | Total number of sustain pulses |
|---|---|---|---|---|---|---|---|---|---|---|---|---|---|
| | | | 1st SF | 2nd SF | 3rd SF | 4th SF | 5th SF | 6th SF | 7th SF | 8th SF | 9th SF | 10th SF | |
| 8th driving mode | 7 | 5.500 | 11<br>2 | 22<br>4 | 44<br>8 | 88<br>16 | 177<br>32 | 355<br>64 | 713<br>128 | | | | 1410 |
| Transition mode | 7 | 1.000 | 2<br>2 | 4<br>4 | 8<br>8 | 16<br>16 | 32<br>32 | 64<br>64 | 128<br>128 | | | | 254 |
| Normal driving mode | 10 | 1.000 | 1<br>1 | 2<br>2 | 3<br>3 | 6<br>6 | 12<br>12 | 22<br>22 | 37<br>37 | 45<br>45 | 57<br>57 | 71<br>71 | 256 |

PLASMA DISPLAY PANEL DRIVING METHOD AND PLASMA DISPLAY DEVICE

This application is a U.S. National Phase Application of PCT International Application PCT/JP2007/053293.

TECHNICAL FIELD

The present invention relates to a method of driving a plasma display panel for use in a wall-mounted television or a large monitor, and to a plasma display device.

BACKGROUND ART

An alternating-current surface-discharging panel representative of a plasma display panel (hereinafter abbreviated as "panel") has a large number of discharge cells formed between the front plate and the rear plate faced with each other.

For the front plate, a plurality of display electrode pairs, each made of a scan electrode and a sustain electrode, are formed on a front glass substrate in parallel with each other. A dielectric layer and a protective layer are formed to cover these display electrode pairs. For the rear plate, a plurality of parallel data electrodes are formed on a rear glass substrate and a dielectric layer is formed over the data electrodes to cover them. Further, a plurality of barrier ribs are formed on the dielectric layer in parallel with the data electrodes. Phosphor layers are formed over the surface of the dielectric layer and the side faces of the barrier ribs.

Then, the front plate and the rear plate are faced with each other and sealed together so that the display electrode pairs are intersected with data electrodes. A discharge gas containing xenon having a partial pressure of 5% is charged into the inside discharge space. Discharge cells are formed in portions where the respective display electrode pairs are faced with the corresponding data electrodes. In a panel structured as above, gas discharge generates ultraviolet light in each discharge cell. This ultraviolet light excites the phosphors of red (R), green (G), and blue (G) so that the phosphors emit the respective colors for color display.

A general method of driving a panel is a sub-field method; one field period is divided into a plurality of sub-fields and combinations of light-emitting sub-fields provide gradation display.

Each sub-field has a setup period, an address period, and a sustain period. In the setup period, initializing discharge is generated to form, on the respective electrodes, wall charge necessary for the succeeding addressing operation. There are two kinds of initializing operations: an initializing operation for generating the initializing discharge in all the discharge cells (hereinafter abbreviated as "all-cell initializing operation"); and an initializing operation for generating the initializing discharge in the discharge cells having generated sustaining discharge therein (hereinafter "selective initializing operation").

In the address period, addressing discharge is generated selectively in the discharge cells to be used to display an image, to form wall charge. Then, in the sustain period, alternately applying sustain pulses to the display electrode pairs each made of a scan electrode and a sustain electrode generates sustaining discharge in the discharge cells having generated addressing discharge therein, and causes the phosphor layers of the corresponding discharge cells to emit light. Thus, an image is displayed.

Among the sub-field methods, a novel driving method is disclosed. In this driving method, initializing discharge using a gradually changing voltage waveform and further selectively initializing the discharge cells having generated sustaining discharge therein minimize light emission unrelated to gradation display and improves the contrast ratio.

Specifically, among a plurality of sub-fields, the all-cell initializing operation for causing discharge in all the discharge cells is performed in the setup period in one sub-field, and the selective initializing operation for initializing only the discharge cells having generated the sustaining discharge therein is performed in the setup periods in the other sub-fields. As a result, light emission unrelated to display is only the light emission resulting from the discharge of the all-cell initializing operation. Thus, an image having high contrast can be displayed (see Patent Document 1, for example).

In such driving, the luminance of the area displaying a black picture (hereinafter abbreviated as "black picture level") that changes depending on the light emission unrelated to the image display is only the weak light emission in the all-cell initializing operation. Thus, an image having high contrast can be displayed.

Further proposed as a technology for enhancing the visibility of an image by enhancing the luminance is to detect the average picture level (hereinafter "APL") of input image signals and control the number of sustain pulses in the sustain period according to the APL (see Patent Document 2, for example).

The number of sustain pulses in each sub-field can be determined by multiplying a ratio of brightness at which the sub-field is to be displayed (hereinafter "brightness weight") by a proportionality factor (hereinafter "luminance factor"). In this technology, the luminance factor is controlled according to an APL to determine the number of the sustain pulses in each sub-field. When an image signal has a high APL, the luminance factor is controlled to be small. When an image signal has a low APL, i.e., the entire image is dark, the luminance factor is controlled to be large. Such control can increase the luminance of a display image having a low APL and display a dark image brighter to enhance visibility of the image.

However, in recent years, larger panels with higher definition have been requiring higher contrast in the display images.

[Patent Document 1] Japanese Patent Unexamined Publication No. 2000-242224

[Patent Document 2] Japanese Patent Unexamined Publication No. H11-231825

SUMMARY OF THE INVENTION

The present invention addresses the above problem and provides a panel driving method and a plasma display device capable of displaying a vigorous image having enhanced maximum luminance and thus enhanced contrast.

For this purpose, the panel driving method of the present invention displays an image by dividing one filed of a supplied display image into a plurality of sub-fields each having a setup period, an address period, and a sustain period. In the setup period, initializing discharge is generated in discharge cells. Each of the discharge cells includes display electrode pairs each made of a scan electrode and a sustain electrode. In the address period, addressing discharge is generated in the discharge cells. In the sustain period, sustain pulses set for each of the sub-fields are applied to the display electrode pairs to generate sustaining discharge. This method includes a step of reducing the number of sub-fields in one field period, and a step of increasing the total number of the sustain pulses in one field period, when the display image changes from a normal image to a predetermined image meeting predetermined conditions. This method further includes a step of reducing the total number of the sustain pulses in one field period, and a step of increasing the number of the sub-fields in one field period, when the display image changes from the predetermined image to the normal image. This method can provide a panel driving method and a plasma display device capable of displaying a vigorous image having enhanced maximum luminance and enhanced contrast.

BRIEF DESCRIPTION OF THE DRAWINGS

FIG. 5 is a table showing sub-field structures in accordance with the exemplary embodiment of the present invention.

FIG. 11 is a table showing an example of sub-field structures in the high contrast mode, a transition mode, and the normal driving mode in accordance with the exemplary embodiment.

REFERENCE MARKS IN THE DRAWINGS

Figure 1:
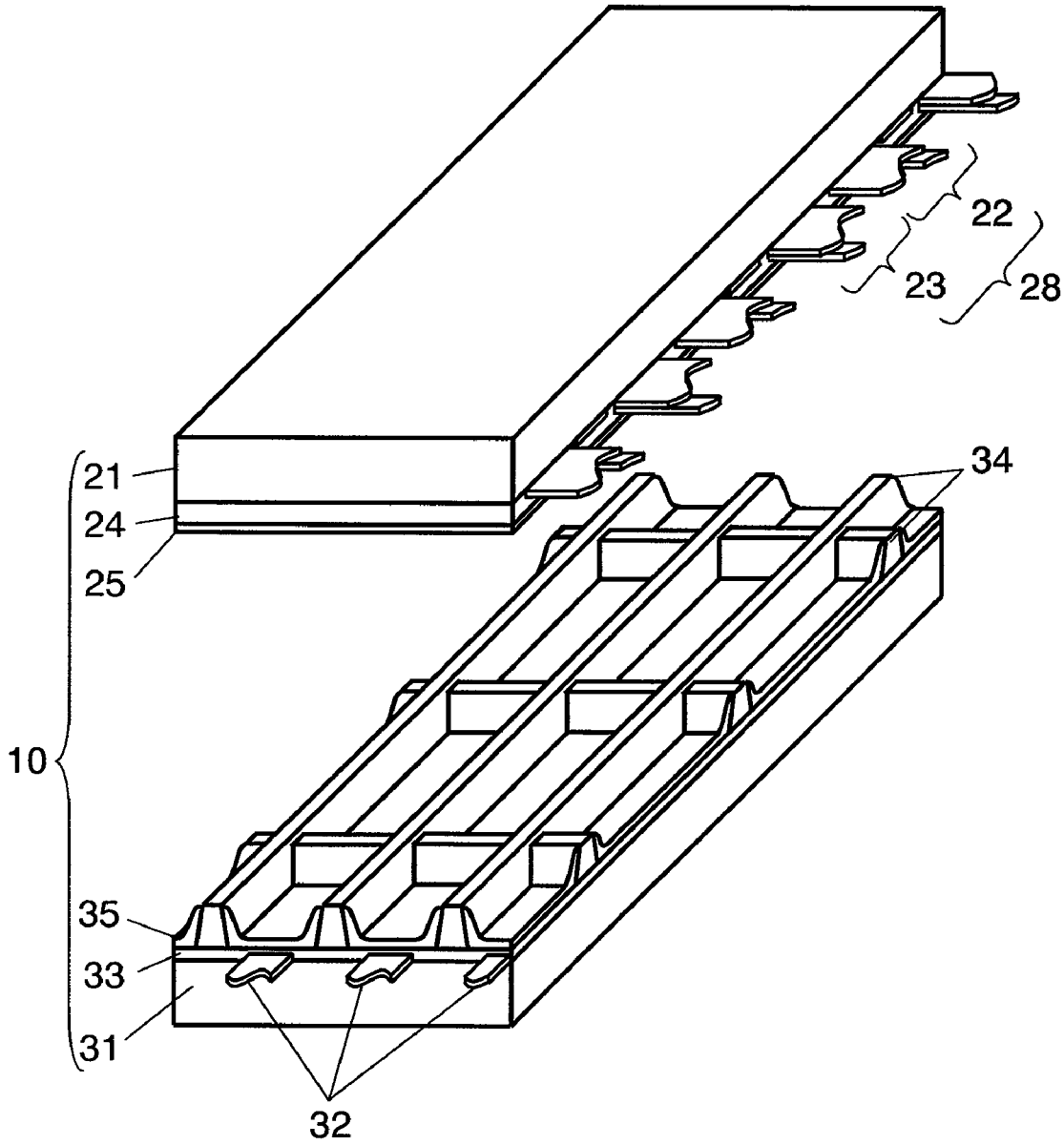
FIG. 1 is an exploded perspective view illustrating a structure of a panel in accordance with an exemplary embodiment of the present invention.

10 Panel
21 (Glass) front plate
22 Scan electrode
23 Sustain electrode
24, 33 Dielectric layer
25 Protective layer
28 Display electrode pair
31 Rear plate
32 Data electrode
34 Barrier rib
35 Phosphor layer
51 Image signal processing circuit
52 Data electrodes driver circuit
53 Scan electrodes driver circuit
54 Sustain electrodes driver circuit
55 Timing generating circuit
57 APL detector circuit
61 Maximum luminance detector circuit
62 Still image detector circuit
63, 66 Image judgment circuit
65 Light-emitting rate detector circuit

DETAILED DESCRIPTION OF PREFERRED EMBODIMENT

Hereinafter, a description is provided of a plasma display device in accordance with an exemplary embodiment of the present invention, with reference to the accompanying drawings.

Exemplary Embodiment

FIG. 1 is an exploded perspective view illustrating a structure of panel 10 in accordance with the exemplary embodiment of the present invention. A plurality of display electrode pairs 28, each made of scan electrode 22 and sustain electrode 23, are formed on glass front plate 21. Dielectric layer 24 is formed to cover scan electrodes 22 and sustain electrodes 23. Protective layer 25 is formed over dielectric layer 24. A plurality of data electrodes 32 are formed on rear plate 31. Dielectric layer 33 is formed to cover data electrodes 32. On the dielectric layer, barrier ribs 34 are formed in a double cross. Further, over the side faces of barrier ribs 34 and dielectric layer 33, phosphor layers 35 for emitting red (R), green (G), or blue (B) light are provided.

These front plate 21 and rear plate 31 are faced with each other sandwiching a small discharge space therebetween so that display electrode pairs 28 are intersected with data electrodes 32. The outer peripheries of the plates are sealed with a sealing material, such as a glass frit. In the discharge space, a mixed gas of neon and xenon, for example, is charged as a discharge gas. In this exemplary embodiment, a discharge gas having a xenon partial pressure of 10% is used to improve the luminance. The discharge space is partitioned into a plurality of compartments by barrier ribs 34. Discharge cells are formed at intersections between display electrode pairs 28 and data electrodes 32. Discharge and light emission of these discharge cells allow image display.

The structure of the panel is not limited to the above, and may include stripe-like barrier ribs.

Figure 2:
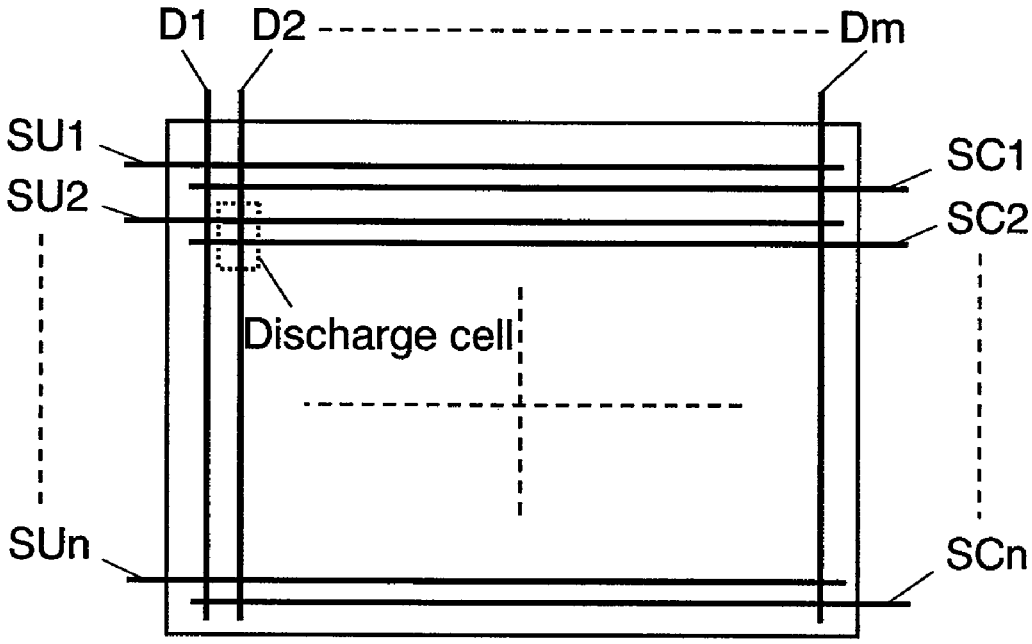
FIG. 2 is a diagram illustrating an array of electrodes in the panel.

FIG. 2 is a diagram showing an array of electrodes in panel 10 in accordance with the exemplary embodiment of the present invention. Panel 10 includes n scan electrodes SC1 to SCn (scan electrodes 22 in FIG. 1) and n sustain electrodes SU1 to SUn (sustain electrodes 23 in FIG. 1) both long in the row direction, and m data electrodes D1 to Dm (data electrodes 32 in FIG. 1) long in the column direction. A discharge cell is formed in a portion in which a pair of scan electrode SCi (i=1 to n) and sustain electrode SUi (i=1 to n) are intersected with one data electrode Dj (j=1 to m). Thus, m×n discharge cells are formed in the discharge space.

Figure 3:
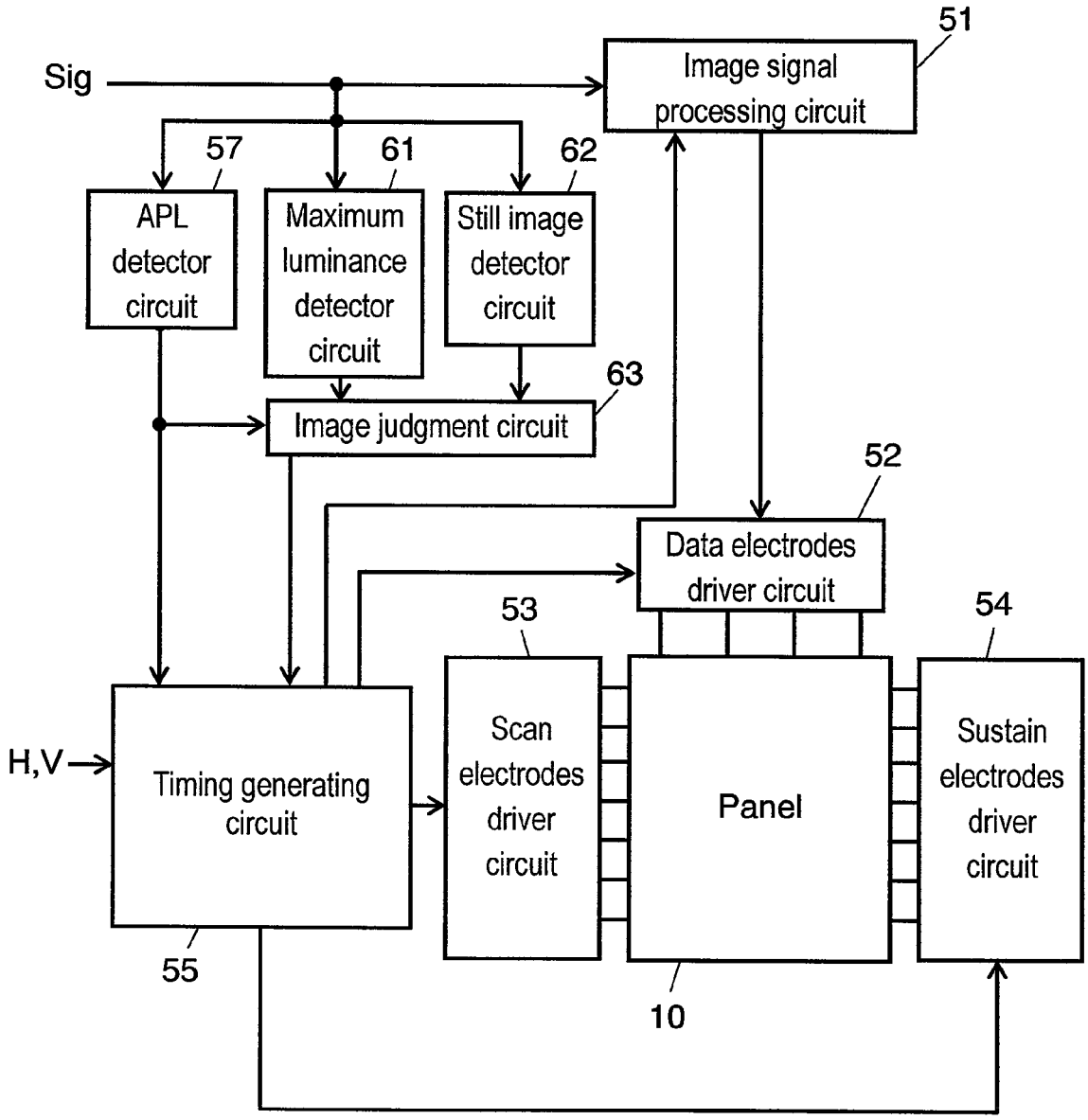
FIG. 3 is a circuit block diagram of driver circuits for driving the panel.

FIG. 3 is a circuit block diagram of driver circuits for driving the panel in accordance with the exemplary embodiment of the present invention. The plasma display device includes panel 10, image signal processing circuit 51, data electrodes driver circuit 52, scan electrodes driver circuit 53, sustain electrodes driver circuit 54, timing generating circuit 55, APL detector circuit 57, maximum luminance detector circuit 61, still image detector circuit 62, image judgment circuit 63, and power supply circuits (not shown) for supplying necessary power to the respective circuit blocks.

Image signal processing circuit 51 converts supplied image signal sig into image data showing whether the discharge cells are to be lit or not per sub-field so that the supplied image signal can be displayed as a display image on panel 10. Data electrodes driver circuit 52 converts the image data per sub-field into signals corresponding to respective data electrodes D1 to Dm, and drives respective data electrodes D1 to Dm.

APL detector circuit 57 detects the APL of image signal sig. Specifically, the APL is detected by a known technique of accumulating the luminance values of image signals in one field period or one frame period, for example. Other than the luminance values, R signals, G signals, and B signals may be accumulated in one field period and their averages are obtained to detect an APL.

Maximum luminance detector circuit 61 detects the maximum luminance of image signals in one field period for each of the fields. Alternatively, the respective maximum values of R signals, G signals, and B signals in one field period may be detected.

Still image detector circuit 62 includes a storage (not shown) for storing image data therein. The still image detector circuit determines whether the image to be displayed is a moving image or a still image using a known still image detection method of comparing the current image data with the image data stored in the memory, and outputs the result.

Image judgment circuit 63 judges whether the image to be displayed is a predetermined image meeting predetermined conditions or a normal image other than the predetermined image. Specifically, according to the respective detection results of APL detector circuit 57, maximum luminance detector circuit 61, and still image detector circuit 62, the image judgment circuit judges whether the image is a predetermined image or not, and outputs the result to timing generating circuit 55. The predetermined image is a still image and the image signals thereof to be displayed have an APL lower than a first APL threshold and the maximum luminance equal to or larger than a maximum luminance threshold. (Hereinafter an image meeting all these conditions is referred to as "high contrast image".) When the maximum luminance detector circuit 61 is structured to output the respective maximum values of R signals, G signals, and B signals, the respective maximum values of these signals are compared with corresponding maximum luminance thresholds. Then, judgment of high contrast signals can be made using the AND of the comparison results.

In this exemplary embodiment, the first APL threshold is set at 4.4% and the maximum luminance threshold is set at 94%. Image judgment circuit 63 outputs a still image that has an APL lower than the first APL threshold and a maximum luminance equal to or larger than the maximum luminance threshold, as a high contrast image. Examples of such a high contrast image include an image of a night sky with the moon or stars, and an image of white letters against a dark background. Though not so frequently displayed, these images have small areas having high luminance against a background of large areas having low luminance. Thus, the contrast in these images can be improved remarkably.

Based on horizontal synchronizing signal H, vertical synchronizing signal V, the APL, and the judgment result of image judgment circuit 63, timing generating circuit 55 generates various kinds of timing signals for controlling the operation of respective circuit blocks, and supplies the timing signals to the respective circuit blocks. A detailed description will be given later. In this exemplary embodiment, when the image to be displayed is a high contrast image, timing signals for providing a larger total number of sustain pulses in one field period than the total number in a normal image are fed into scan electrodes driver circuit 53 and sustain electrodes driver circuit 54 to make control of enhancing the contrast.

Scan electrodes driver circuit 53 drives respective scan electrodes SC1 through SCn according to the timing signals. Sustain electrode driver circuit 54 drives respective scan electrodes SU1 through SUn according to the timing signals.

Next, a description is provided of driving voltage waveforms for driving panel 10 and the operation thereof. The plasma display panel provides gradation display by the sub-field method; one field period is divided into a plurality of sub-fields and whether to light the respective discharge cells or not is controlled for each of the sub-fields for gradation display. Each sub-field has a setup period, an address period, and a sustain period. In the setup period, initializing discharge is generated to form, on the respective electrodes, wall charge necessary for the succeeding addressing discharge. At this time, one of an all-cell initializing operation and a selective initializing operation is performed. The all-cell initializing operation causes initializing discharge in all the discharge cells. The selective initializing operation causes initializing discharge selectively in the discharge cells having generated sustaining discharge therein. In the address period, addressing discharge is generated selectively in the discharge cells to be lit so as to form wall charge. In the sustain period, alternate application of the number of sustain pulses proportional to the brightness weight to the display electrode pairs causes sustaining discharge in the discharge cells having generated addressing discharge therein to emit light. The proportionality factor used at this time is called a luminance factor. The sub-field structures are detailed later. Now, the driving voltage waveforms in the sub-fields and the operation thereof are described.

Figure 4:
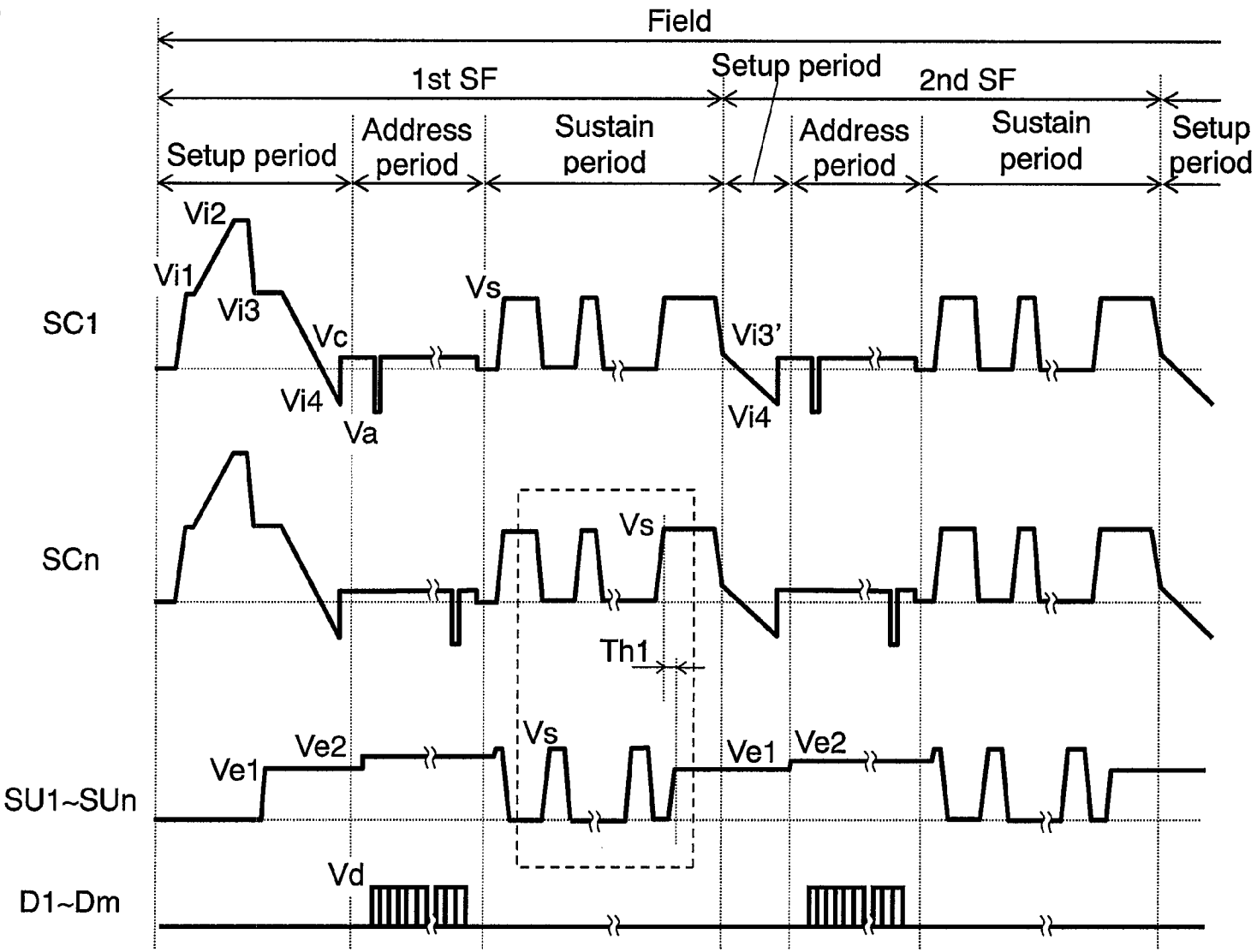
FIG. 4 is a diagram showing driving voltage waveforms applied to the respective electrodes of the panel.

FIG. 4 is a diagram showing driving voltage waveforms applied to the respective electrodes in panel 10 in accordance with the exemplary embodiment of the present invention. FIG. 4 shows a sub-field in which the all-cell initializing operation is performed and a sub-field in which the selective initializing operation is performed.

First, a description is provided of the sub-field for causing the all-cell initializing operation.

In the first half of the setup period, a voltage of 0(V) is applied to respective data electrodes D1 to Dm and sustain electrodes SU1 to SUn. Applied to scan electrodes SC1 to SCn is a ramp waveform voltage that gradually increases from voltage Vi1 of a breakdown voltage or lower toward voltage Vi2 exceeding the breakdown voltage with respect to sustain electrodes SU1 to SUn. While this ramp waveform voltage is increasing, weak initializing discharge occurs between scan electrodes SC1 to SCn and sustain electrodes SU1 to SUn, and between scan electrodes SC1 to SCn and data electrodes D1 to Dm. Then, negative wall voltage accumulates on scan electrodes SC1 to SCn. Positive wall voltage accumulates on data electrodes D1 to Dm and sustain electrodes SU1 to SUn. Now, the wall voltage on the electrodes means the voltage generated by wall charge accumulated on the dielectric layer, protective layer, phosphor layers, or the like covering the electrodes.

In the second half of the setup period, a positive voltage of Ve1 is applied to sustain electrodes SU1 to SUn. Applied to scan electrodes SC1 to SCn is a gradually decreasing ramp waveform voltage (hereinafter "ramp voltage") from voltage Vi3 of the breakdown voltage or lower toward voltage Vi4 exceeding the breakdown voltage with respect to sustain electrodes SU1 to SUn. During this application, weak initializing discharge occurs between scan electrodes SC1 to SCn and sustain electrodes SU1 to SUn, and between scan electrodes SC1 to SCn and data electrodes D1 to Dm. This weak discharge weakens the negative wall voltage on scan electrodes SC1 to SCn and the positive wall voltage on sustain electrodes SU1 to SUn, and adjusts the positive wall voltage on data electrodes D1 to Dm to a value appropriate for the addressing operation. Thus, the all-cell initializing operation for causing initializing discharge in all the discharge cells is completed.

In the succeeding address period, voltage Ve2 is applied to sustain electrodes SU1 to SUn, and voltage Vc is applied to scan electrodes SC1 to SCn. Next, negative scan pulse voltage Va is applied to scan electrode SC1 in the first row, and positive address pulse voltage Vd is applied to data electrodes Dk (k=1 to m) of the discharge cells to be lit in the first row among data electrodes D1 through Dm. At this time, the voltage difference at the intersections between data electrodes Dk and scan electrode SC1 is the addition of the difference in externally applied voltage (Vd−Va), and the difference between the wall voltage on data electrodes Dk and the wall voltage on scan electrode SC1, thus exceeding the breakdown voltage. Then, addressing discharge occurs between data electrodes Dk and scan electrode SC1, and between sustain electrode SU1 and scan electrode SC1. Positive wall voltage accumulates on scan electrode SC1 and negative wall voltage accumulates on sustain electrode SU1. Negative wall voltage also accumulates on data electrodes Dk. In this manner, the addressing operation is performed to cause addressing discharge in the discharge cells to be lit in the first row and to accumulate wall voltage on the corresponding electrodes. On the other hand, because the voltage at the intersections between data electrodes D1 to Dm subjected to no address pulse voltage Vd and scan electrode SC1 does not exceed the breakdown voltage, addressing discharge does not occur. The above addressing operation is performed on the discharge cells in the first to the n-th rows and the address period is completed.

In the succeeding sustain period, first, positive sustain pulse voltage Vs is applied to scan electrodes SC1 to SCn, and 0(V) is applied to sustain electrodes SU1 to SUn. Then, in the discharge cells having generated addressing discharge therein, the voltage difference between scan electrode SCi and sustain electrode SUi is the addition of sustain pulse voltage Vs and the difference between the wall voltage on scan electrode SCi and the wall voltage on sustain electrode SUi, thus exceeding the breakdown voltage. Then, sustaining discharge occurs between scan electrode SCi and sustain electrode SUi, and ultraviolet light generated at this time causes phosphor layers 35 to emit light. Thus, negative wall voltage accumulates on scan electrode SCi, and positive wall voltage accumulates on sustain electrodes SUi. Positive wall voltage also accumulates on data electrodes Dk. In the discharge cells having generated no addressing discharge in the address period, no sustaining discharge occurs and the wall voltage at the completion of the setup period is maintained.

Successively, 0(V) is applied to scan electrodes SC1 to SCn, and sustain pulse voltage Vs is applied to sustain electrode SU1 to SUn. Then, in the discharge cell having generated sustaining discharge therein, the voltage difference between sustain electrode SUi and scan electrode SCi exceeds the breakdown voltage, thereby causing sustaining discharge between sustain electrode SUi and scan electrode SCi again. Thus, negative wall voltage accumulates on sustain electrode SUi, and positive wall voltage on scan electrode SCi. Similarly, the number of sustain pulses resulting from multiplication of the brightness weight by the luminance factor are alternately applied to scan electrodes SC1 to SCn and sustain electrodes SU1 to SUn to give a potential difference between the electrodes of the display electrode pairs. Thus, sustaining discharge is continued in the discharge cells having generated addressing discharge therein in the address period. In this exemplary embodiment, the number of sub-fields, or the brightness weight or the luminance factor of each sub-field is not fixed. The number of sub-fields, and the brightness weight and the luminance factor of each sub-field are changed according to the APL of the image to be displayed and whether or not the image is a high contrast image. This structure will be detailed later.

At the end of the sustain period, a voltage difference of so-called a narrow pulse is given between scan electrodes SC1 to SCn and sustain electrodes SU1 to SUn. Thereby, while positive wall voltage remains on data electrodes Dk, the wall voltage on scan electrode SCi and sustain electrode SUi is erased.

Next, a description is provided of the operation in the sub-field for causing the selective initializing operation.

In the setup period of the selective initializing operation, voltage Ve1 is applied to sustain electrodes SU1 to SUn, and 0(V) is applied to data electrodes D1 to Dm. A ramp voltage gradually decreasing from voltage Vi3' toward voltage Vi4 is applied to scan electrodes SC1 to SCn. In the discharge cells having generated sustaining discharge therein in the sustain period of the preceding sub-field, weak initializing discharge occurs, and weakens the wall voltage on scan electrode SCi and sustain electrode SUi. On data electrodes Dk, sufficient positive wall voltage is accumulated by the preceding sustaining discharge, and thus the excessive wall charge is discharged and adjusted to wall charge appropriate for the addressing operation. On the other hand, in the discharge cells having generated no sustaining discharge therein in the preceding sub-field, no discharge occurs, and the wall charge at the completion of the setup period of the preceding sub-field is maintained. In this manner, in the selective initializing operation, the initializing discharge is performed selectively on the discharge cells subjected to the sustaining operation in the sustain period of the preceding sub-field.

The operation in the succeeding address period is the same as the operation in the address period of the sub-field for causing the all-cell initializing operation. Thus, the description is omitted. The operation in the succeeding sustain period is the same except for the number of sustain pulses.

Next, a description is provided of sub-field structures. FIG. 5 is a table showing sub-field structures in accordance with the exemplary embodiment of the present invention. In this exemplary embodiment, images are displayed by using either sub-field structures for displaying a normal image other than a high contrast image (hereinafter abbreviated as "normal driving mode") or sub-field structures for displaying a high contrast image (hereinafter "high contrast mode").

In this exemplary embodiment, the normal driving mode is a generic term for 115 sub-field structures having different luminance factors. Each of the sub-field structures has 10 sub-fields (the first SF, and second SF through 10th SF). The respective sub-fields have brightness weights of 1, 2, 3, 6, 12, 22, 37, 45, 57, and 71. In the setup period of the first SF, the all-cell initializing operation is performed. In the setup periods of the second through the 10th SFs, the selective initializing operations are performed. Then, control is made so that a sub-field structure having a smaller luminance factor is used at a high APL. As the APL decreases, a sub-field structure having a larger luminance factor is used to display images. FIG. 5 shows a sub-field structure having a luminance factor of 1 and a sub-field structure having a luminance factor of 3.25, as the normal driving mode.

In the normal driving mode, the luminance factors are controlled according to the APL in this manner. When the APL is low and the entire screen is dark, increasing the number of lighting operations at the same rate in the entire screen makes the entire screen brighter. Thus, while a dark atmosphere is kept, a reliable image having high contrast can be displayed. When the APL is high and a larger number of discharge cells are lit, the number of lighting operations is decreased to reduce power consumption of the plasma display device.

For the high contrast mode, eight examples of sub-field structures having different luminance factors are shown in this exemplary embodiment. Each of the first driving mode through the third driving mode has nine sub-fields, and brightness weights of 1, 2, 4, 8, 16, 32, 48, 64, and 80. Each of the fourth driving mode through the seventh driving mode has eight sub-fields, and brightness weights of 1, 2, 4, 8, 16, 32, 64, and 128. The eighth driving mode has seven sub-fields and brightness weights of 2, 4, 8, 16, 32, 64, and 128. The luminance factors in the first driving mode through the eighth driving mode are 3.518, 3.750, 3.997, 4.260, 4.541, 4.841, 5.160, and 5.500, respectively. Thus, the total numbers of sustain pulses in one field period in the first driving mode through the eighth driving mode are 898, 958, 1021, 1087, 1160, 1237,1317, and 1410, respectively. In this manner, for the high contrast mode, the luminance factors are larger and the total number of sustain pulses in one field is larger than those of the normal driving mode. This structure can make the displayable maximum luminance (hereinafter "peak luminance") higher than that of the normal driving mode. For example, the eighth driving mode having the largest luminance factor (the total number of sustain pulses being 1410) can exhibit a peak luminance approximately 1.7 times the peak luminance of the normal driving mode having a luminance factor of 3.25 (the total number of sustain pulses being 829).

In this exemplary embodiment, the above numbers of sub-fields and sustain pulses are set by timing generating circuit 55 according to the APL of the image signals and the judgment result of image judgment circuit 63. Then, timing signals are generated to provide driving voltage waveforms having those numbers of sub-fields and sustain pulses, and fed into scan electrodes driver circuit 53, sustain electrodes driver circuit 54, and data electrodes driver circuit 52. Scan electrodes driver circuit 53, sustain electrodes driver circuit 54, and data electrodes driver circuit 52 generate driving voltage waveforms having the above numbers of sub-fields and sustain pulses, according to the respective timing signals, and drive scan electrodes 22, sustain electrodes 23, and data electrodes 32, respectively.

In the high contrast mode, to make the luminance factors larger than those in the normal driving mode, the sub-field structures are made so that each sub-field has a brightness weight of 2n (n=integer) or a value close thereto and the number of sub-fields is reduced. It is known that image display using sub-field structures having less redundant brightness weights can generate so-called pseudo contours. In other words, contours that do not originally exist are generated in moving portions of the display image or contours are generated by ocular oscillation when intermediate gradation is displayed in a large area. However, in this exemplary embodiment, the high contrast image is a still image, and the light-emitting area is small. Thus, such pseudo contours do not occur. In the eighth driving mode, the smallest brightness weight is two and the number of displayable gradations is 127. However, because fine gradation differences are not remarkable in the high contrast images, even displaying an image using the eighth driving mode can improve the peak luminance substantially without degrading the image display quality.

In this manner, this exemplary embodiment is structured so that the total number of the sustain pulses in one field period can be changed. When a high contrast image is displayed, the total number of the sustain pulses in one field period is made larger than the number of the sustain pulses in a normal image other than the high contrast image. The total number of the sustain pulses can be changed by changing the proportionality factor, or changing the number of sub-fields together with the proportionality factor.

Figure 6:
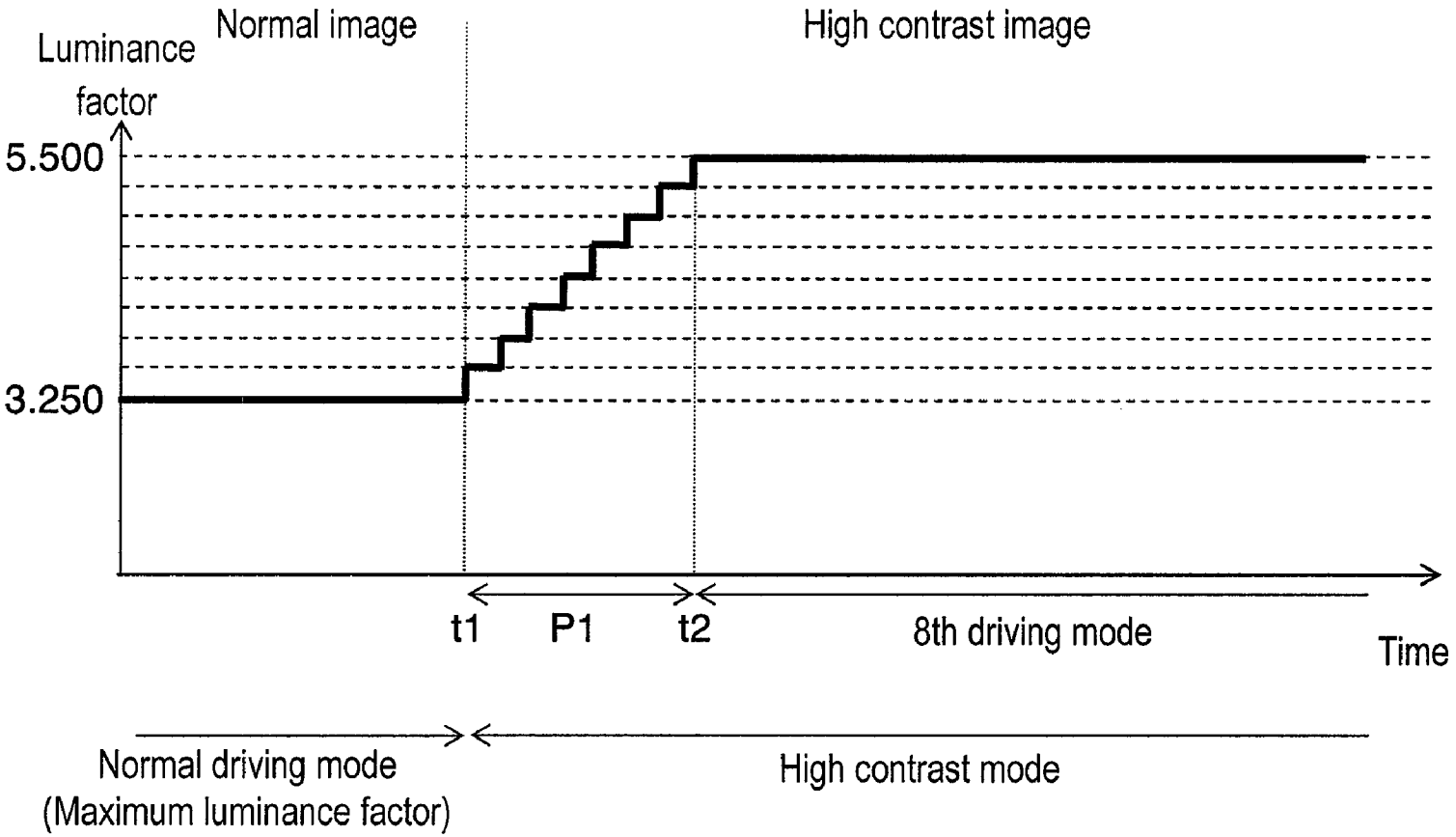
FIG. 6 is a graph showing an example of how a normal driving mode is switched to a high contrast mode in accordance with the exemplary embodiment.

Next, a description is provided of a method of switching from the normal driving mode to the high contrast mode. In this exemplary embodiment, when the normal driving mode is switched to the high contrast mode, e.g. the eighth driving mode, the normal driving mode is not switched directly to the eighth driving mode. Instead, a driving mode having a smaller luminance factor is switched to driving modes having larger luminance factors in steps so that a rapid change in the peak luminance can be prevented. FIG. 6 is a graph showing an example of how the normal driving mode is switched to the high contrast mode in accordance with the exemplary embodiment. FIG. 6 shows changes in luminance factor with time from the normal driving mode having the largest luminance factor to the eighth driving mode in the high contrast mode. Now, the luminance factor and the peak luminance are substantially proportional to each other. Thus, FIG. 6 also shows changes in peak luminance during the switchover of the driving modes.

In the example of driving mode switchover of FIG. 6, at time t1 when the display image is changed to a high contrast image, the normal driving mode is switched to the first driving mode in the high contrast mode. Thereafter, the mode is switched to the second driving mode, the third driving mode, and the other driving modes having larger luminance factors in steps. At time t2, the mode is switched to the eighth driving mode. In predetermined period P1, i.e. from time t1 to time t2, the peak luminance gradually increases. Thus, in this exemplary embodiment, when the normal driving mode is switched to the high contrast mode, the luminance factor of the driving mode is increased in steps, and the total number of sustain pulses in one field period is increased in steps. This structure gradually increases the peak luminance and thus displays high contrast images without giving a sense of discomfort.

Figure 7:
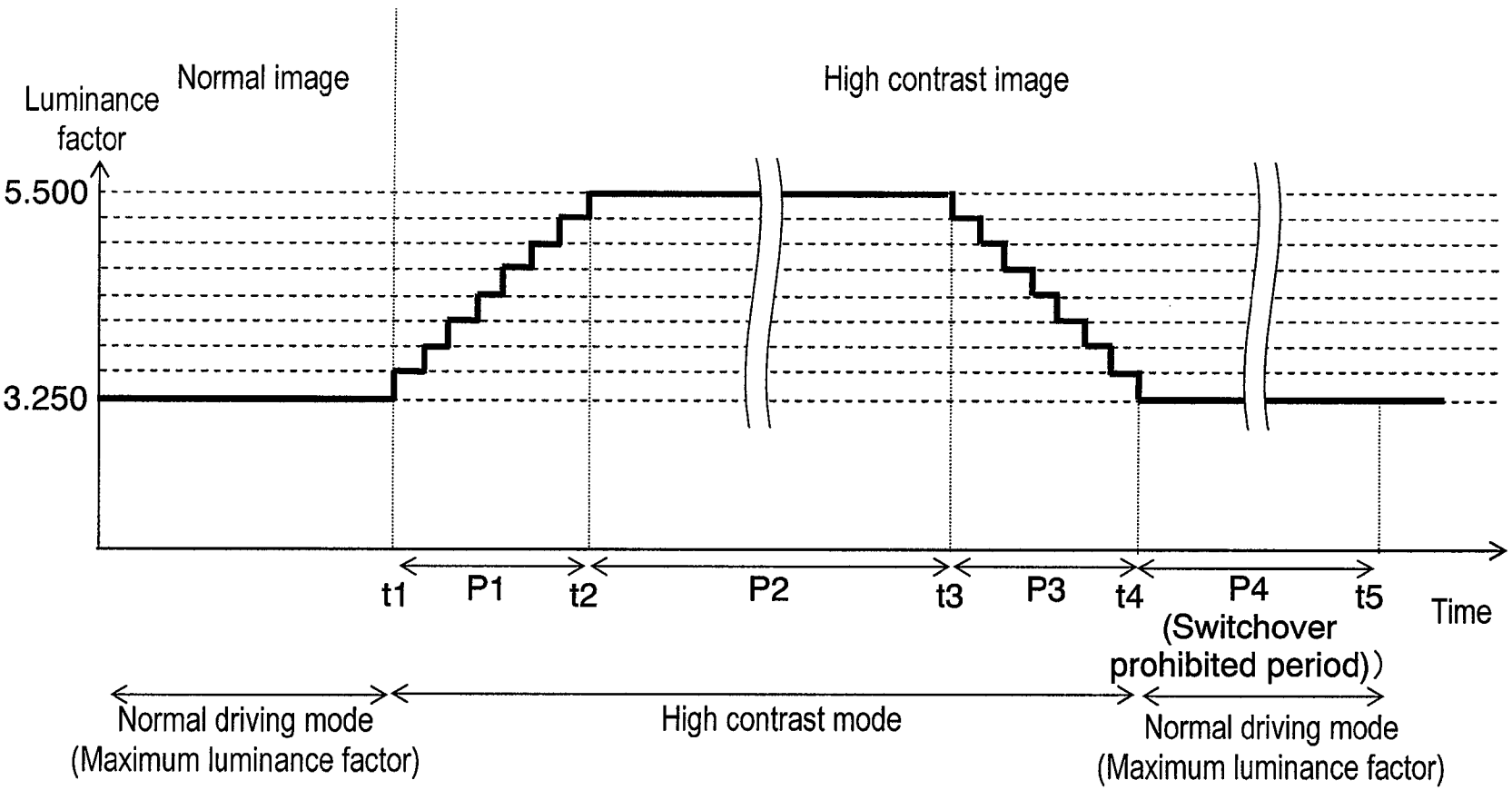
FIG. 7 is a graph showing how driving modes are switched when a time period for using the high contrast mode is limited.

In the high contrast mode, the luminance factors and the numbers of sustain pulses are large, and thus scan electrodes driver circuit 53 and sustain electrodes driver circuit 54 tend to consume more power. To address this problem, the time period for using the high contrast mode to display the image may be limited. FIG. 7 is a graph showing how driving modes are switched over when the time period for using the high contrast mode is limited in the exemplary embodiment of the present invention. In this exemplary embodiment, after the mode is switched to the eighth driving mode at time t2, the image is displayed by using the eighth driving mode until time t3. Thereafter, the mode is switched to the seventh driving mode, the sixth driving mode, and the other driving modes having smaller luminance factors in steps, and is switched to the normal driving mode at time t4. Now, among the time period for using the high contrast mode, setting period P2 from time t2 to time t3 of FIG. 7 longer to a certain degree and setting the period for switching from the high contrast mode to the normal driving mode, i.e. period P3 from time t3 to time t4, longer can gradually decrease the peak luminance without significantly affecting the impression of high contrast images. In this manner, appropriately setting period P2 and period P3 can suppress the power consumption of the plasma display device without significantly affecting the impression of high contrast images.

In this exemplary embodiment, period P1 is set at 4 seconds, period P2 at 30 seconds, and period P3 at 4 seconds. Preferably, period P1 ranges from 2 seconds to 8 seconds inclusive, period P2 ranges from 15 seconds to 60 seconds inclusive, and period P3 ranges from 2 seconds to 8 seconds inclusive. The luminance factors of the respective driving modes in the high contrast mode are set so that the rates of changes in peak luminance range from approximately 3% to 5% in periods P1 and P2.

Further, period P4 (switchover prohibited period from time t4 to time t5 of FIG. 7) for prohibiting the switchover of the driving modes may be provided immediately after the high contrast mode is switched to the normal mode so that the normal mode is not switched to the high contrast mode again. This structure can further suppress the power consumption of the plasma display device. In this exemplary embodiment, period P4 is set in the range of 30 seconds to 60 seconds.

Figure 8:
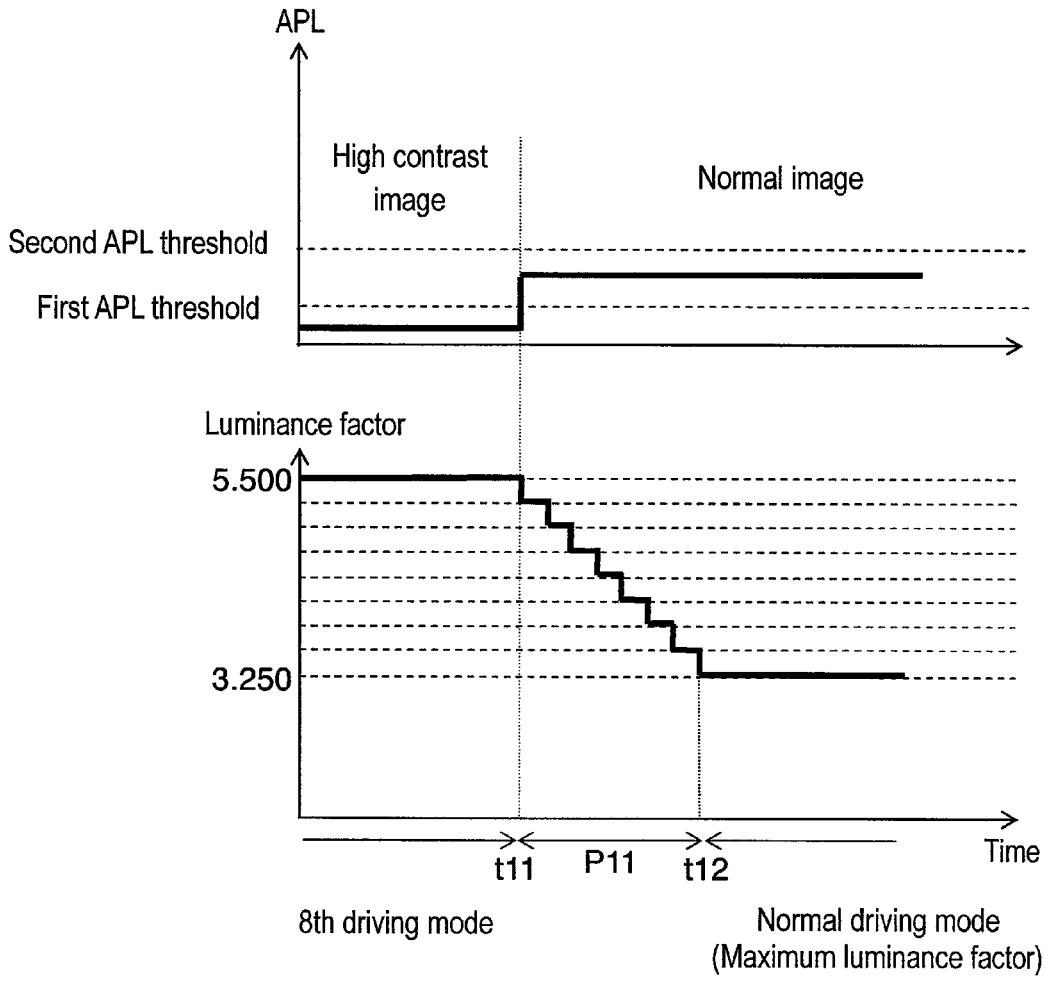
FIG. 8 is a graph showing how the high contrast mode is switched to the normal driving mode in accordance with the exemplary embodiment.
Figure 9:
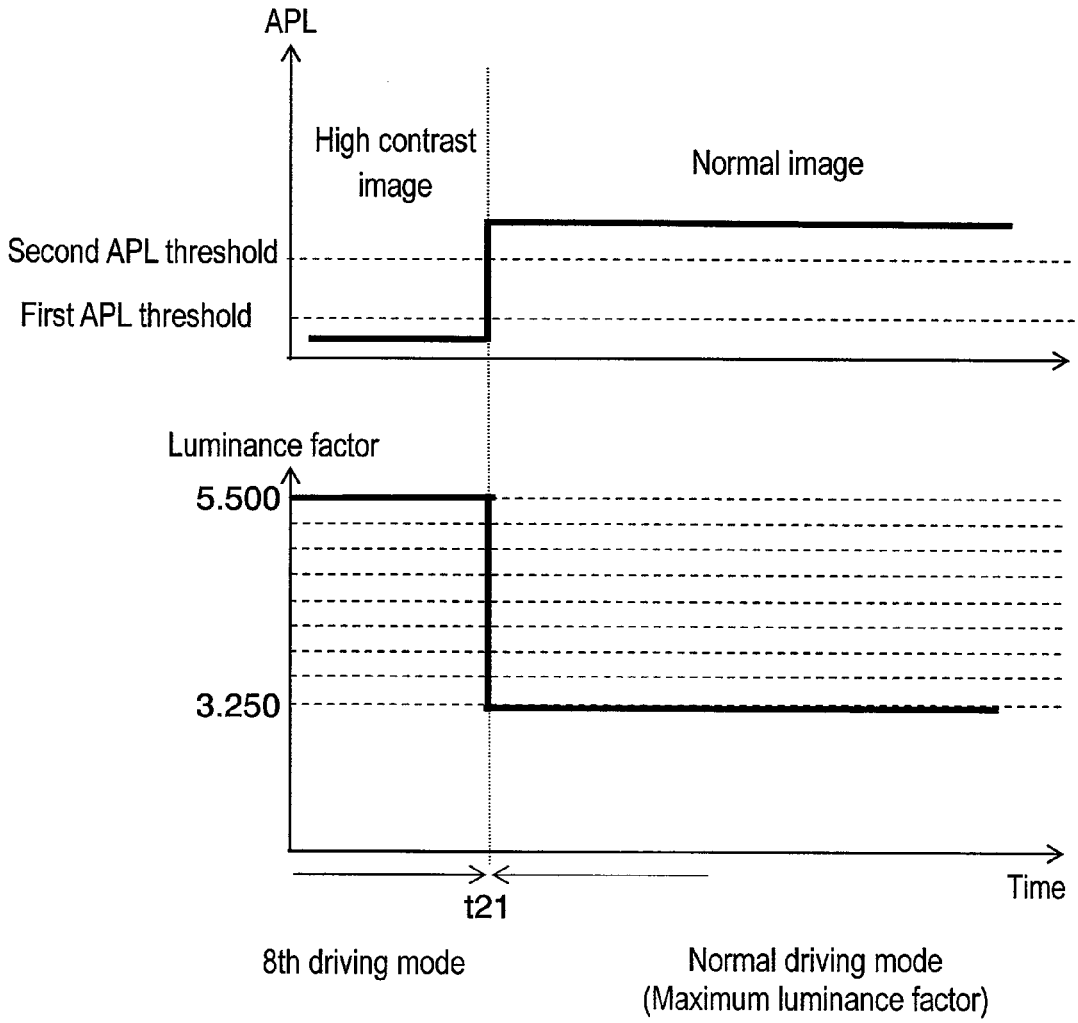
FIG. 9 is a graph showing how the high contrast mode is switched to the normal driving mode in accordance with the exemplary embodiment.

Next, a description is provided of how to switch from the high contrast mode to the normal driving mode. In this exemplary embodiment, this switchover method is controlled according to the APL of the display image. FIG. 8 and FIG. 9 are graphs each showing how the high contrast mode is switched to the normal driving mode in accordance with the exemplary embodiment. When image judgment circuit 63 judges the APL of a normal image changed from a high contrast image is relatively low, the mode is switched to the seventh driving mode, the sixth driving mode, and the other driving modes having smaller luminance factors in steps, as shown in FIG. 8. Then, at time t12, the mode is switched to the normal driving mode. In this exemplary embodiment, the predetermined time taken for this switchover, i.e. period P11 from t11 to t12, is set between 4 seconds and 16 seconds. In this manner, stepwise decreases in luminance factor and the total number of sustain pulses in one field can gradually decrease the peak luminance and make the luminance change less conspicuous.

On the other hand, when image judgment circuit 63 judges the APL of a normal image changed from a high contrast image is relatively high, the high contrast mode is switched directly to the normal driving mode at time t21, i.e. the moment when the display image is changed to the normal image, as shown in FIG. 9. In this manner, for a normal image having a relatively high APL, large variations of the APL make the luminance change less conspicuous, and thus the driving mode can promptly be switched in response to image signals. In this exemplary embodiment, a second APL threshold is provided. When the APL at the changeover from a high contrast image to a normal image is lower than the second threshold value, the mode is switched to driving modes having smaller luminance factors in steps, and then to the normal driving mode. When the APL at the changeover from the high contrast image to the normal image is equal to or higher than the second threshold value, the mode is switched directly to the normal driving mode. In this exemplary embodiment, the second APL threshold is set at 6.8%.

As described above, in this exemplary embodiment, when the display image is changed from a normal image to a high contrast image, the total number of the sustain pulses in one field period is increased in steps within a predetermined period after the image has been changed to the high contrast image. When the display image is changed from a high contrast image to a normal image, two different cases occur. When the average picture level (APL) of the normal image is lower than the second APL threshold, the total number of the sustain pulses in one field period is reduced in steps within a predetermined period after the display image is changed from the high contrast image to the normal image. When the APL of the normal image is equal to or higher than the second APL threshold, the total number of the sustain pulses in one field period is reduced concurrently with the changeover of the display image from the high contrast image to the normal image.

Figure 10:
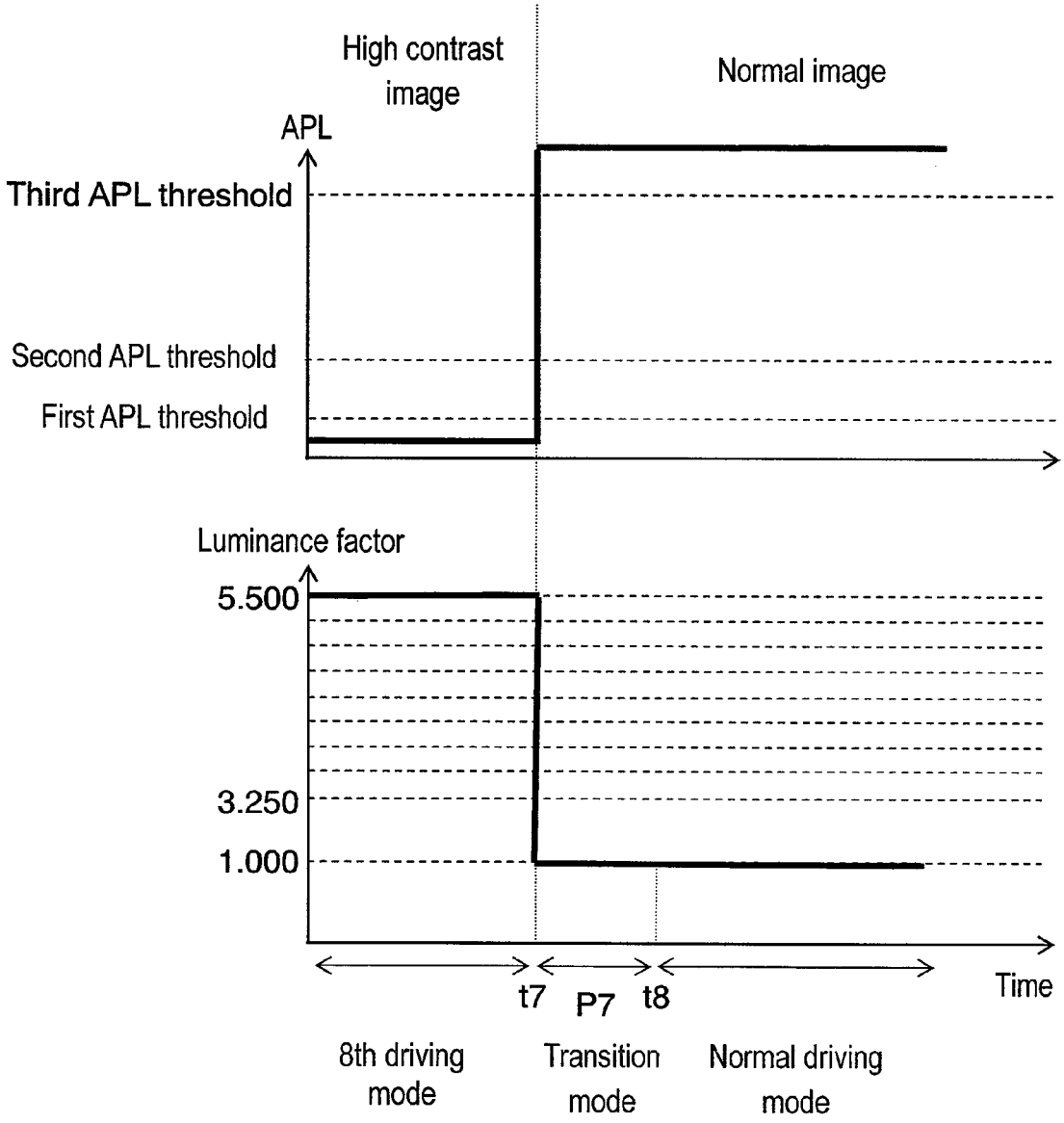
FIG. 10 is a graph showing how the high contrast mode is switched to the normal driving mode in accordance with the exemplary embodiment.

If the power supply capability of the power source in a plasma display device is not so large, the following phenomenon can occur. When the display image is changed from a high contrast image to a normal image, the power consumption of the data electrodes driver circuit may increase sharply and cause a momentary drop in address pulse voltage Vd. However, in this exemplary embodiment, when the normal image changed from the high contrast image has an especially high APL, the following control is further made to prevent a drop in address pulse voltage Vd. FIG. 10 is a graph showing how the high contrast mode is switched to the normal driving mode in accordance with the exemplary embodiment. When image judgment circuit 63 judges the APL of a normal image changed from a high contrast image is relatively high, at time t7 when the display image is changed to the normal image, the mode is once switched to a driving mode having the same number of sub-fields as those of the high contrast mode and the same luminance factor as that of the normal driving mode to be switched to (hereinafter "transition mode"), as shown in FIG. 10. Then, at time t8, the transition mode is switched to the normal driving mode. FIG. 11 is a table showing an example of sub-field structures in the high contrast mode, the transition mode, and the normal driving mode in accordance with the exemplary embodiment of the present invention. As shown in the table, in the transition mode, the luminance factor is the same as that of the normal driving mode to be switched to, and the total number of the sustain pulses in one field is substantially equal to the total number of the sustain pulses in the normal driving mode. Thus, the luminance of the display image is the same as that in the normal driving mode. However, the smaller number of sub-fields reduces the number of addressing operations, and thus can suppress the power consumption of the data electrode driver circuit and a sharp increase in power.

In this exemplary embodiment, a third APL threshold is provided. When the APL of a normal image changed from a high contrast image is equal to or higher than the third APL threshold, the high contrast mode is not switched directly to the normal driving mode. Instead, the high contrast mode is switched to the transition mode once, and then to the normal driving mode. The third APL threshold is set at 33% in this exemplary embodiment. However, this value is a simple example. Preferably, appropriate values are set according to the characteristics of the panel and the specifications of the plasma display device.

In the description of this exemplary embodiment, the luminance factor in the transition mode is equal to the luminance factor in the succeeding normal driving mode. However, these values need not be strictly equal to each other. These values can be set so that a viewer does not feel a sense of visual discomfort at the switchover.

As described above, in this exemplary embodiment, when the display image is changed from a high contrast image to a normal image, concurrently with the changeover of the display image from the high contrast image to the normal image, the total number of the sustain pulses in one field period is reduced and thereafter the number of sub-fields in one field period is increased. Such control is made when the average picture level (APL) of a normal image changed from a high contrast image is equal to or higher than the third APL threshold.

In this exemplary embodiment, the first APL threshold is set at 4.4%, and the second APL threshold is set at 6.8%. However, these values are simple examples. Preferably, appropriate values are set according to the characteristics of the panel and the specifications of the plasma display device.

As described above, in this exemplary embodiment, at display of a high contrast image that is a still image and has a small display area and a low APL, an image having high peak luminance can be displayed. This structure can provide a more beautiful image and, for example, makes twinkles of stars more vivid in the scene of a dark starlit sky.

In the description of this exemplary embodiment, the high contrast mode includes eight driving modes, i.e. the first driving mode through the eighth driving mode. However, the present invention is not limited to this structure. The number of driving modes may be larger or smaller than eight.

The above values of period P1, period P2, period P3, and period P4, the rate of changes in peak luminance, and the like are simple examples. Preferably, appropriate values are set according to the characteristics of the panel and the specifications of the plasma display device.

In the description of this exemplary embodiment, a high contrast image is detected using an APL thereof. Instead of the APL, the rate of lit discharge cells with respect to the number of all discharge cells (hereinafter abbreviated as "light-emitting rate") may be used.

Figure 12:
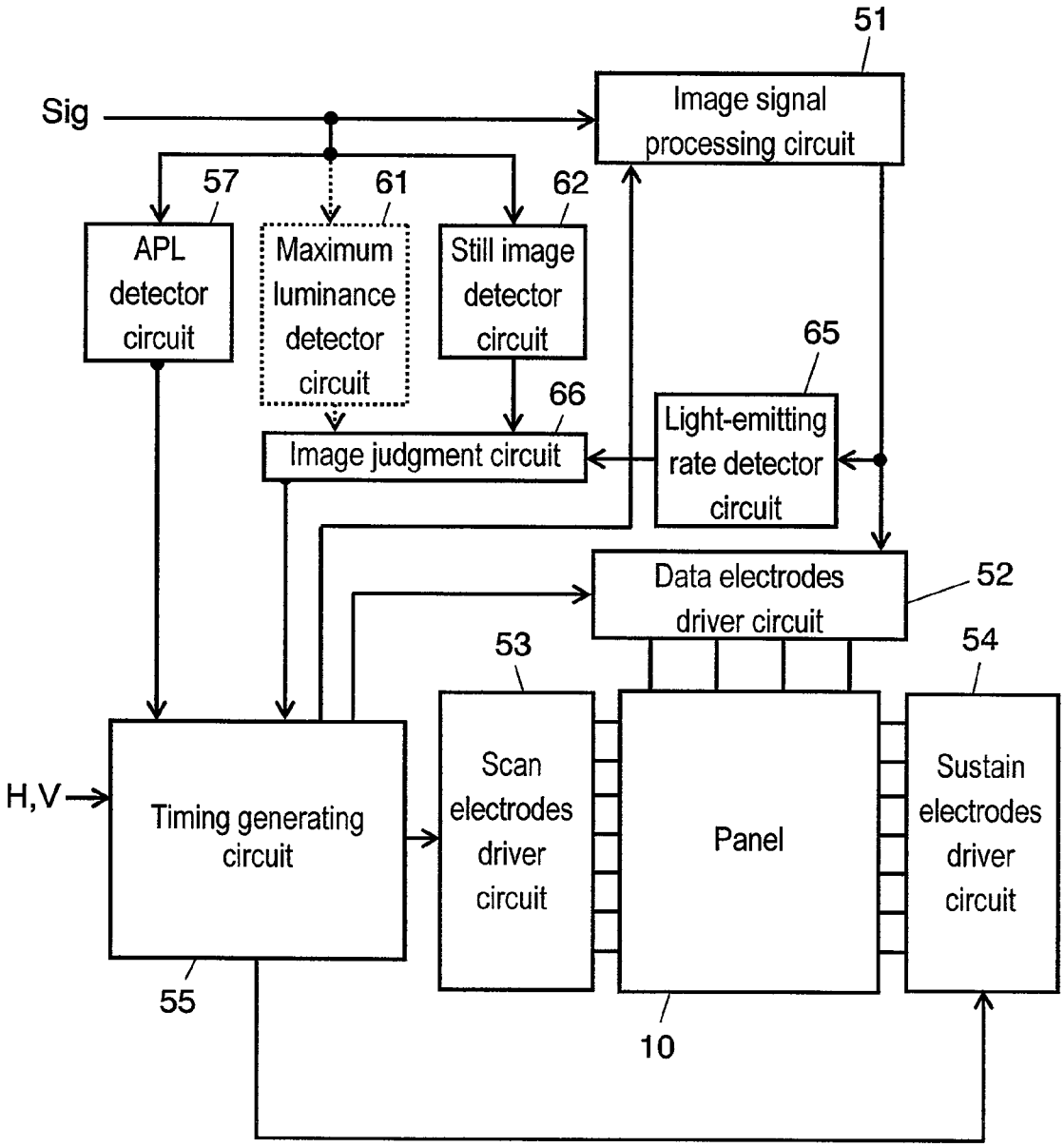
FIG. 12 is a circuit block diagram of a plasma display device including a light-emitting rate detector circuit for detecting light-emitting rates in accordance with another exemplary embodiment of the present invention.

FIG. 12 is a circuit block diagram of a plasma display device including a light-emitting rate detector circuit for detecting light-emitting rates in accordance with another exemplary embodiment of the present invention. Light-emitting rate detector circuit 65 detects a light-emitting rate for each of sub-fields, according to the image data of the sub-field. As a high contrast image, image judgment circuit 66 can judge an image that has light-emitting rates in predetermined sub-fields detected by light-emitting rate detector circuit 65 smaller than a light-emitting rate threshold, and the maximum luminance detected by maximum luminance detector circuit 61 equal to or larger than a maximum luminance threshold, and is defined as a still image by still image detector circuit 62. For the predetermined sub-fields, some sub-fields that have large brightness weights are selected, for example the light-emitting rate of the 10th sub-field is smaller than 1%, and that of the ninth SF is smaller than 2%. Thus, an image having a low APL can be detected. Alternatively, the light-emitting rates of all the sub-fields are detected and the image judgment circuit may determine an image under the condition where the light-emitting rate is smaller than 4% in every sub-field.

Further, the use of light-emitting rate detector circuit 65 can eliminate maximum luminance detector circuit 61. Specifically, as a high contrast image, image judgment circuit 66 may judge an image that has light-emitting rates in predetermined sub-fields detected by light-emitting rate detector circuit 65 smaller than a light-emitting rate threshold, has the light-emitting rate at least in the sub-field having the largest brightness weight larger than 0%, and is defined as a still image by still image detector circuit 62. In this manner, an image having high maximum luminance can be detected by detecting that the light-emitting rates of some sub-field(SF)s having large brightness weights, e.g. the seventh through the 10th SFs, are not 0%.

In the description of this exemplary embodiment, the APL, maximum luminance, or the like is detected from image signals in one field period. However, the APL and maximum luminance may be detected from image signals in one frame period.

When a plurality of image display modes for displaying images at different brightness or contrast, e.g. a cinema mode, standard mode, and dynamic mode, are set, the control for displaying a high contrast image in this exemplary embodiment may be made only in the dynamic mode for displaying images at the highest contrast, for example.

When the plasma display device further includes a temperature detector for detecting the temperature of the panel or the inside of the case, the high contrast mode at displaying a high contrast image may be controlled also using the temperature detection results from the temperature detector. When the temperature detection results are equal to or lower than a predetermined temperature and panel 10 can be determined to be at a low temperature, the eighth driving mode is not used, for example. In this manner, the control may be made to determine to which modes to be used, according to the temperature detection results.

The various kinds of values used for the description of this exemplary embodiment are simple examples. Preferably, appropriate values are set according to the characteristics of the panel and the specifications of the plasma display device.

Industrial Applicability

The present invention is capable of displaying a vigorous image having enhanced maximum luminance and contrast, and is useful as a panel driving method and a plasma display device.

The invention claimed is:

1. A plasma display panel driving method for displaying an image by dividing one filed of a supplied display image into a plurality of sub-fields, in which the plasma display, panel includes discharge cells, each of the discharge cells includes display electrode pairs, each of the display electrode pairs is made of a scan electrode and a sustain electrode, each of the sub-fields has a setup period for generating initializing discharge in the discharge cells, an address period for generating addressing discharge in the discharge cells, and a sustain period for applying sustain pulses set for each of the sub-fields to the display electrode pairs and generating sustaining discharge, the plasma display panel driving method comprising:

when the display image changes from a normal image to a predetermined image meeting a predetermined condition, reducing the number of the sub-fields in the one field period, and increasing the total number of the sustain pulses in the one field period; and when the display image changes from the predetermined image to the normal image, reducing the total number of the sustain pulses in the one field period, and increasing the number of the sub-fields in the one field period, wherein the predetermined image has an average picture level (APL) lower than a first APL threshold and a maximum luminance equal to or larger than a maximum luminance threshold, and is a still image.

2. The plasma display panel driving method of claim 1, wherein, at changeover of the display image from the predetermined image to the normal image, when an average picture level of the normal image is lower than a second APL threshold, reducing the total number of the sustain pulses in the one field period in steps within a predetermined period after the changeover of the display image from the predetermined image to the normal image; and when the average picture level of the normal image is equal to or higher than the second APL threshold, reducing the total number of the sustain pulses in the one field period concurrently with the changeover of the display image from the predetermined image to the normal image.

3. A plasma display panel driving method for displaying an image by dividing one filed of a supplied display image into a plurality of sub-fields, in which the plasma display panel includes discharge cells, each of the discharge cells includes display electrode pairs, each of the display electrode pairs is made of a scan electrode and a sustain electrode, each of the sub-fields has a setup period for generating initializing discharge in the discharge cells, an address period for generating addressing discharge in the discharge cells, and a sustain period for applying sustain pulses set for each of the sub-fields to the display electrode pairs and generating sustaining discharge, the plasma display panel driving method comprising:

when the display image changes from a normal image to a predetermined image meeting a predetermined condition, reducing the number of the sub-fields in the one field period, and increasing the total number of the sustain pulses in the one field period; and when the display image changes from the predetermined image to the normal image, reducing the total number of the sustain pulses in the one field period, and increasing the number of the sub-fields in the one field period, wherein the predetermined image has a light-emitting rate smaller than a light-emitting rate threshold in predetermined ones of the sub-fields, a light-emitting rate larger than 0% in at least one of the sub-fields having a largest brightness weight, and is a still image.

* * * * *

UNITED STATES PATENT AND TRADEMARK OFFICE

CERTIFICATE OF CORRECTION

PATENT NO. : 8,194,004 B2
APPLICATION NO. : 11/909877
DATED : June 5, 2012
INVENTOR(S) : Kenji Nishimura et al.

It is certified that error appears in the above-identified patent and that said Letters Patent is hereby corrected as shown below:

Page 2, FOREIGN PATENT DOCUMENTS, "SK 2007/053293 9/2010"
should read -- SK Office Action for PCT JP2007/053293 --

At Column 14, claim 1, line 26, "display, panel" should read -- display panel --

Signed and Sealed this
Twenty-third Day of October, 2012

David J. Kappos

David J. Kappos
*Director of the United States Patent and Trademark Office*